US006544076B2

(12) United States Patent
Pocrass

(10) Patent No.: US 6,544,076 B2
(45) **Date of Patent: *Apr. 8, 2003**

(54) DUAL FUNCTION RJ CONNECTOR

(76) Inventor: Alan L. Pocrass, 41 Golden Glen, Simi Valley, CA (US) 93065

( * ) Notice: Subject to any disclaimer, the term of this patent is extended or adjusted under 35 U.S.C. 154(b) by 0 days.

This patent is subject to a terminal disclaimer.

(21) Appl. No.: 09/955,787

(22) Filed: Sep. 19, 2001

(65) Prior Publication Data

US 2003/0013348 A1 Jan. 16, 2003

Related U.S. Application Data

(63) Continuation-in-part of application No. 09/902,448, filed on Jul. 10, 2001.

(51) Int. Cl.[7] ..... H01R 24/00
(52) U.S. Cl. ..... 439/676; 439/218
(58) Field of Search ..... 439/676, 218, 439/217

(56) References Cited

U.S. PATENT DOCUMENTS 4,873,479 A * 10/1989 Iimura et al. ..... 439/218
5,501,608 A * 3/1996 Scheer et al. ..... 439/218
6,027,365 A * 2/2000 Kaufman ..... 439/218
6,116,963 A * 9/2000 Shutter ..... 439/676
6,183,306 B1 * 2/2001 Caveney ..... 439/676
6,190,190 B1 * 2/2001 Daly et al. ..... 439/218
6,193,560 B1 * 2/2001 Morana et al. ..... 439/676
6,210,236 B1 * 4/2001 Kan ..... 439/676

* cited by examiner

*Primary Examiner*—Gary Paumen
(74) *Attorney, Agent, or Firm*—Webb Ziesenheim Logsdon Orkin & Hanson, P.C.

(57) ABSTRACT

A multi-purpose modular connector includes a female housing having an open end and at least two interior surfaces. A first contact terminal configuration is positioned along one of the two interior surfaces and a second contact configuration is positioned along another of the interior surfaces. A male plug having a first plurality of wires and a second plurality of wires is configured to be inserted in the open end of the female housing. When the male plug is inserted into the female housing, at least one first contact terminal contacts a corresponding one of the first plurality of wires and at least one second contact terminal contacts a corresponding one of the second plurality of wires.

23 Claims, 10 Drawing Sheets

DUAL FUNCTION RJ CONNECTOR

CROSS REFERENCE TO RELATED APPLICATIONS

This application is a continuation-in-part of U.S. patent application Ser. No. 09/902,448, filed Jul. 10, 2001, entitled "Dual Function RJ Connector".

BACKGROUND OF THE INVENTION

1. Field of the Invention

The present invention generally relates to modular connectors having a female housing and a removable male plug and, more particularly, to multi-purpose modular connectors.

2. Brief Description of the Prior Art

RJ-type modular connectors generally include an RJ-type female housing configured to releasably receive an RJ-type male plug. RJ-type modular connectors are commonly used in conjunction with electronic telecommunications, data networking equipment, and computers. The female housing is generally a hollow box which defines an internal cavity and four interior surfaces. A latch groove is generally defined adjacent to one of the four interior surfaces. A plurality of contact terminals is positioned inside the interior cavity, adjacent to one of the four interior surfaces and preferably opposite the interior surface defining the latch groove. Each of the contact terminals is electrically connected to a corresponding phone line, wire, printed circuit board lead, or some other system or device. One RJ-type modular connector is described in U.S. Pat. No. 4,978,317 to Pocrass, herein incorporated by reference in its entirety.

The internal cavity of the female housing receives the male plug. The male plug is generally box-shaped and defines four external surfaces, an open end, a closed end, and usually an internal cavity. One of the four external surfaces defines a plurality of partitioned wire grooves, wherein the open end, the internal cavity, and each of the plurality of partitioned wire grooves are connected to one another. A collapsible wire holder may be defined by any one of the four external surfaces, and a flexible latch is usually positioned adjacent to the external surface positioned opposite to the external surface defining the plurality of partitioned wire grooves.

In one typical configuration, a plurality of wires is inserted into the open end of the male plug. One end of each of the plurality of individual wires is positioned in a corresponding one of the plurality of partitioned wire grooves. The collapsible wire holder is then compressed to hold each of the plurality of individual wires securely within the male plug. The male plug is then inserted into the female housing, such that a ridge on the flexible latch releasably seats in the latch groove, and each of the plurality of individual wires contacts a corresponding one of the plurality of contact terminals. The other end of each of the plurality of individual wires may also be individually connected to another male plug in the same manner described above, forming a plurality of individual wires having a housing at both ends.

A significant limitation of prior art RJ-type modular connectors is that the modular connectors are dedicated to one particular function. For example, RJ11 modular connectors are often used in telecommunication applications. RJ11 female housings generally include up to six separate contact terminals, with a corresponding number of male plug partitioned wire grooves. In data networking applications, an RJ45 modular connector is often used. The RJ45 modular connectors generally include up to eight separate contact terminals, with a corresponding number of male partitioned wire grooves, and are specially designed for Local Area Network (LAN) or ETHERNET connectivity. Therefore, if both telecommunication modem and networking capabilities are desired in one particular type of device, such as a computer, the device is generally configured with at least one RJ11 modular connector and at least one RJ45 modular connector. The need for at least two different types of modular connectors increases the size of the device, which is an unwanted design limitation, particularly in the hand-held or laptop computer markets.

SUMMARY OF THE INVENTION

To help ease the limitations currently imposed by the prior art, the present invention generally includes an RJ-type modular connector which includes an RJ-type female housing and an RJ-type male plug. The RJ-type female housing is configured to receive the RJ-type male plug. The RJ-type female housing has an open, plug receiving end and least two interior surfaces. A first RJ-type contact terminal configuration is positioned along one of the interior surfaces, and a second RJ-type contact terminal configuration is positioned along another interior surface, wherein the second RJ-type contact terminal configuration has a different configuration than the first RJ-type contact terminal configuration, and the first and second contact terminal configurations are adapted to selectively mate with the RJ-type male plug when the plug is oriented with respect to the first and second contact terminals.

These and other advantages of the present invention will be clarified in the description of the preferred embodiment taken together with the attached drawings in which like reference numerals represent like elements throughout.

DETAILED DESCRIPTION OF THE PREFERRED EMBODIMENTS

Figure 4:
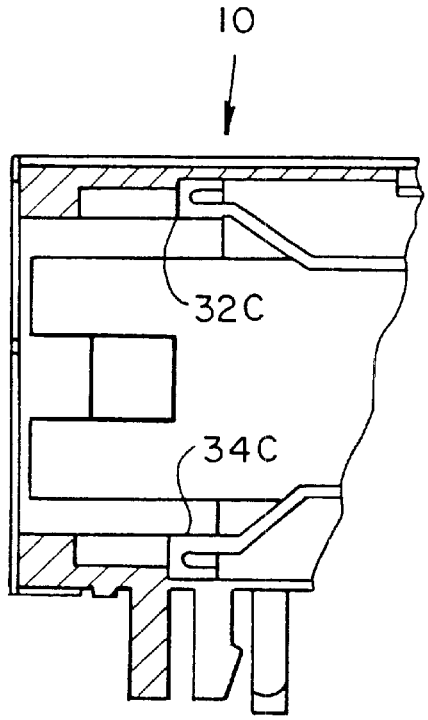
FIG. 4 is a partial cross-sectional side view of the female housing shown in FIG. 1, taken along section line IV—IV, with another type of contact terminal.
Figure 5:
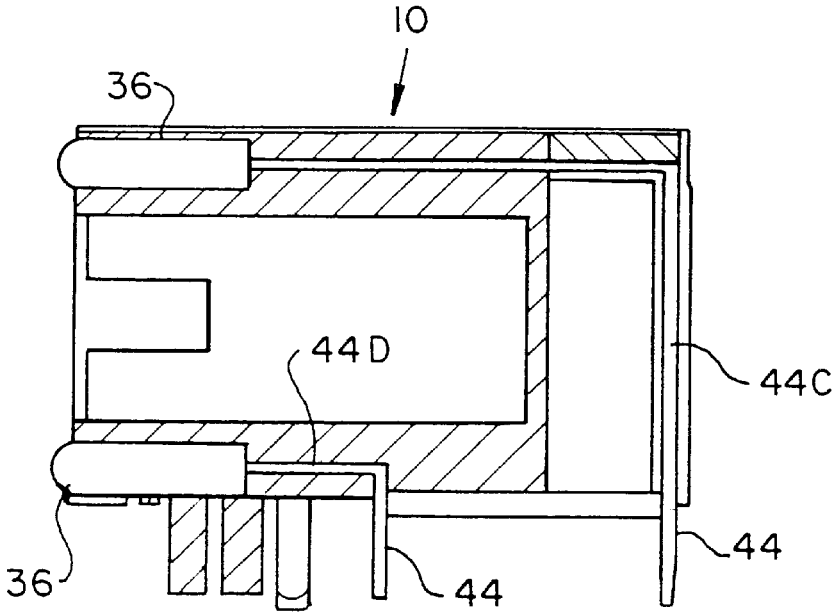
FIG. 5 is a cross-sectional side view of the female housing shown in FIG. 1, taken along section line V—V.
Figure 6:
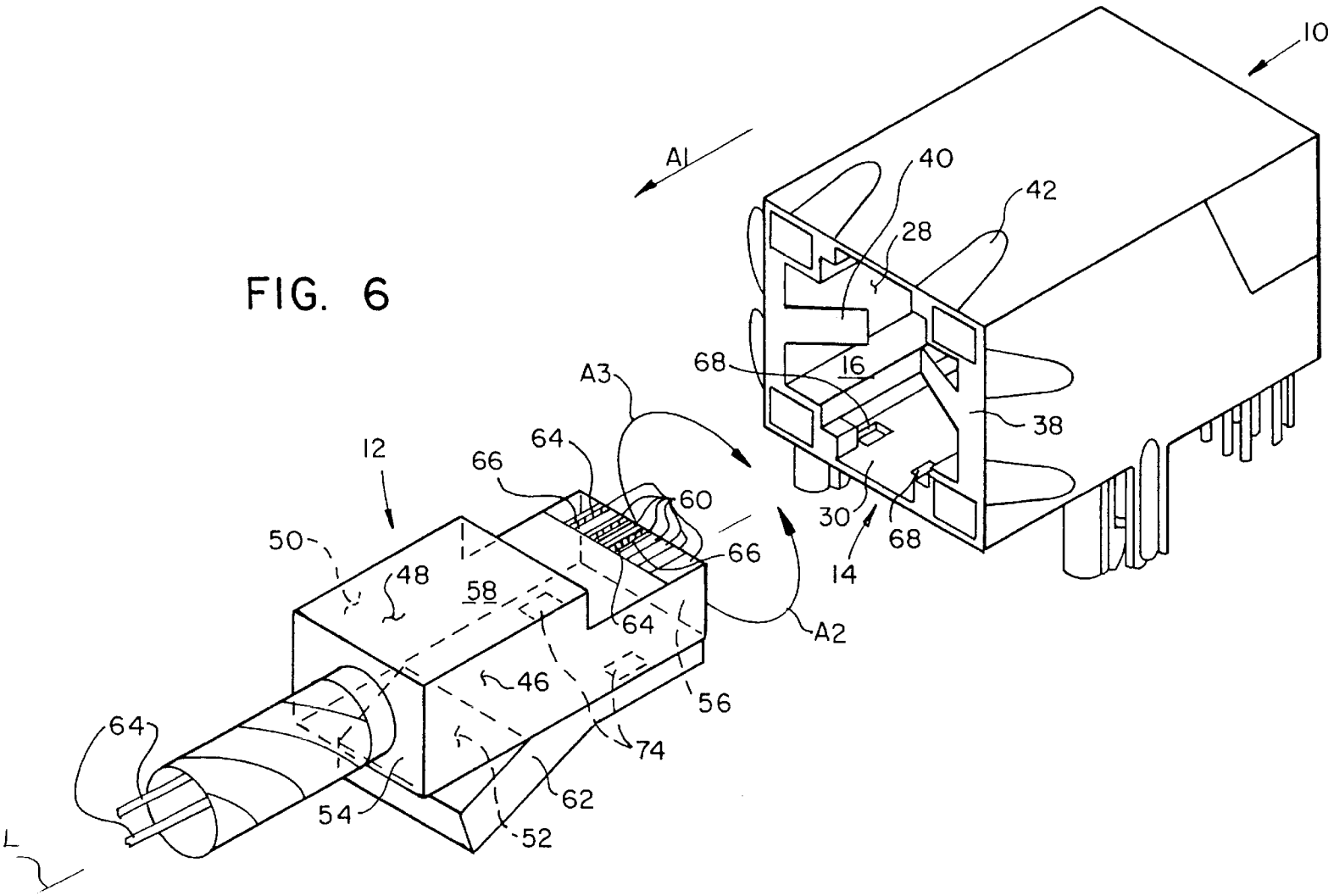
FIG. 6 is a perspective view of the female housing shown in FIG. 1 and a first embodiment male plug according to the present invention.
Figure 7:
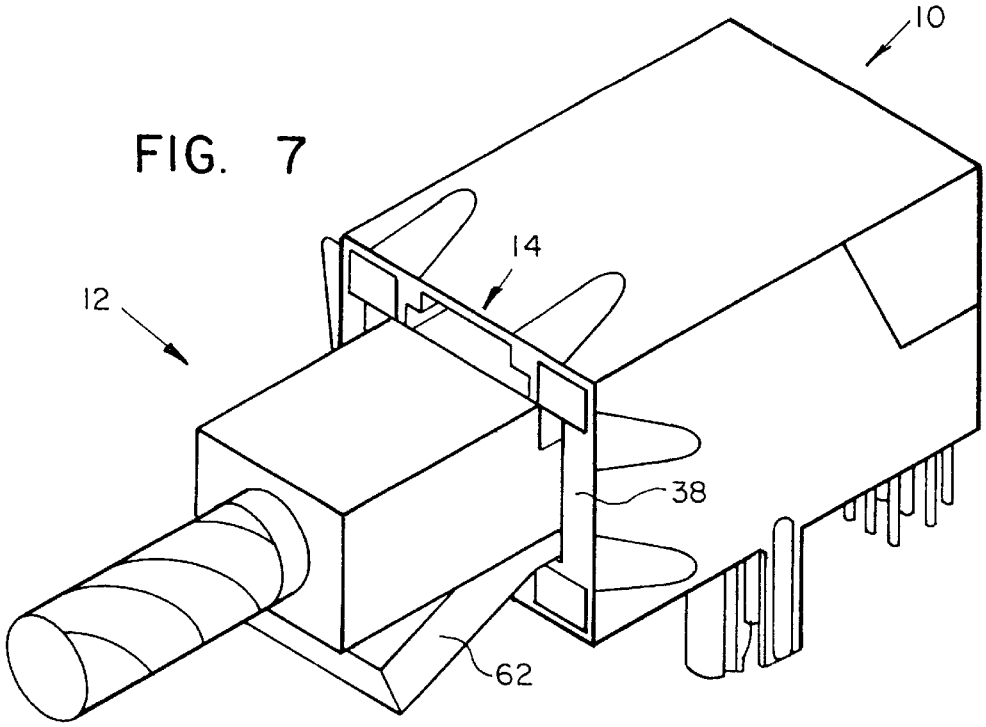
FIG. 7 is a perspective view of the female and male plugs shown in FIG. 6 connected in a first orientation.
Figure 8:
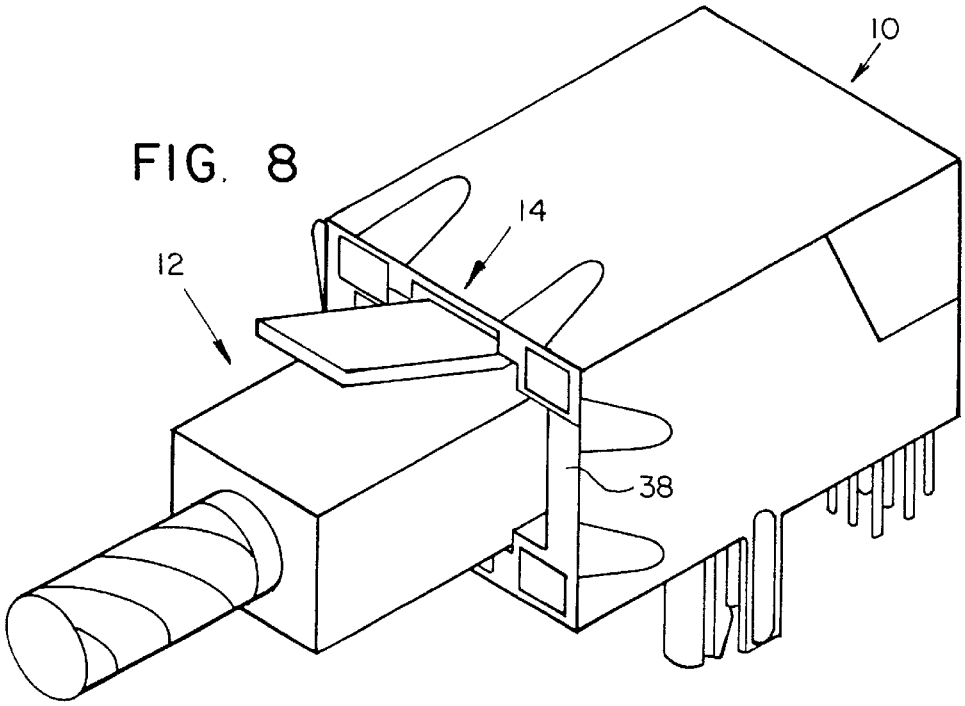
FIG. 8 is a perspective view of the female and male plugs shown in FIGS. 6–7 connected in a second orientation.
Figure 9:
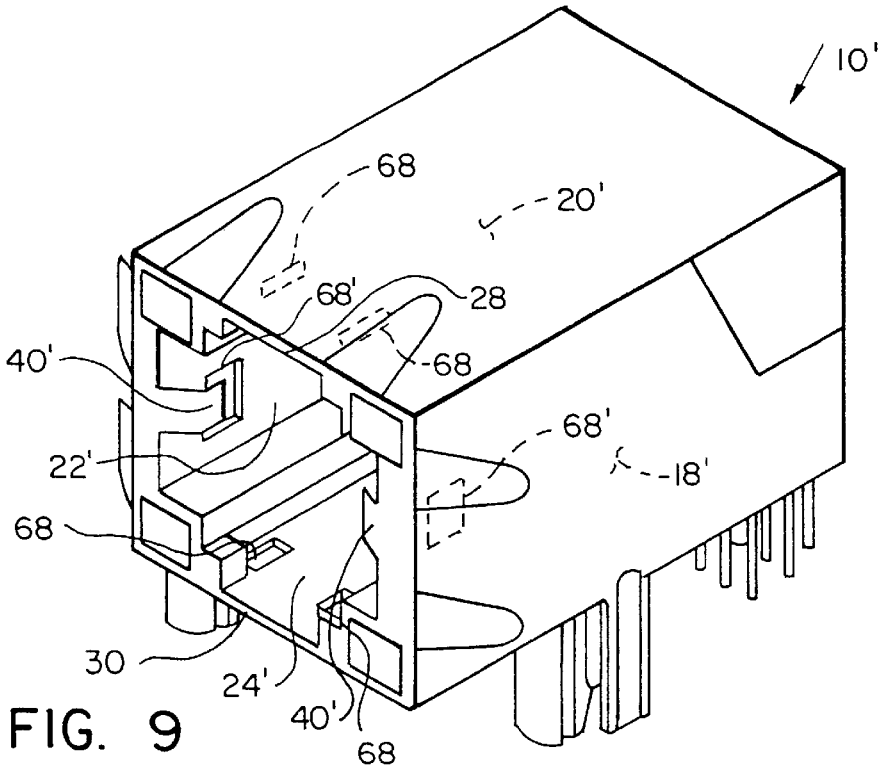
FIG. 9 is a perspective view of a second embodiment female housing according to the present invention.
Figure 14:
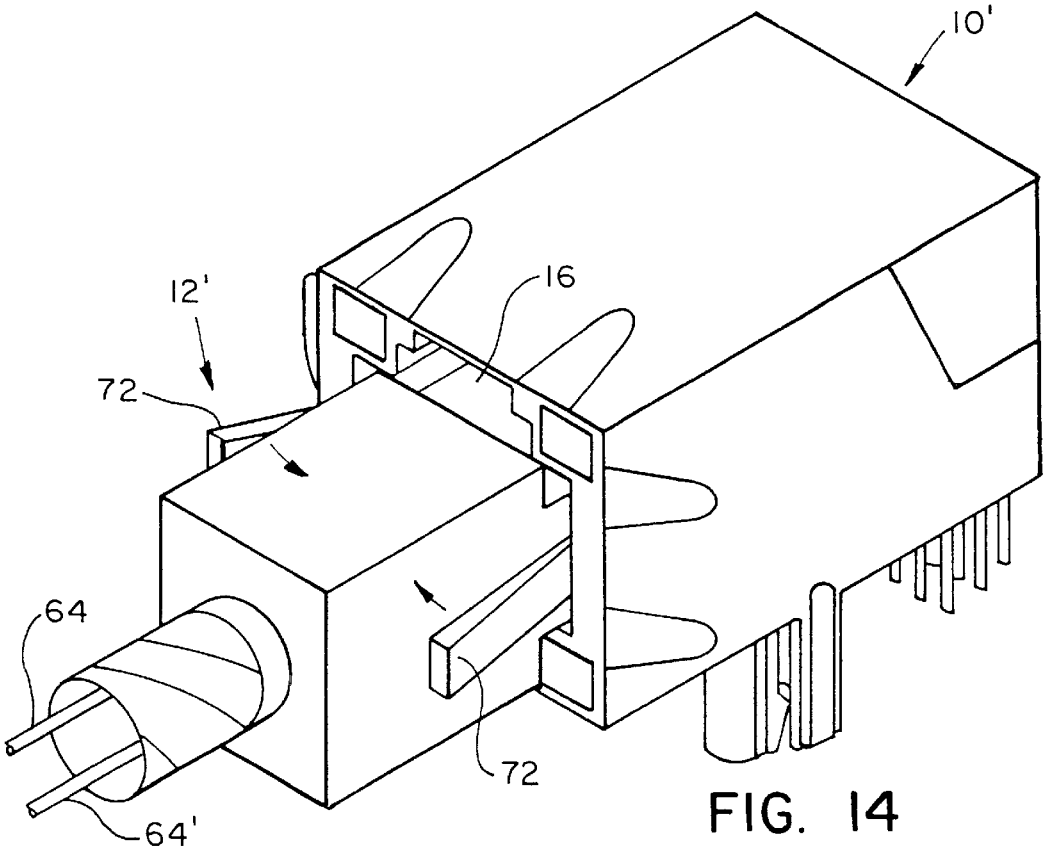
FIG. 14 is a perspective view of the female housing and male plug shown in FIG. 13 releasably connected together.
Figure 10:
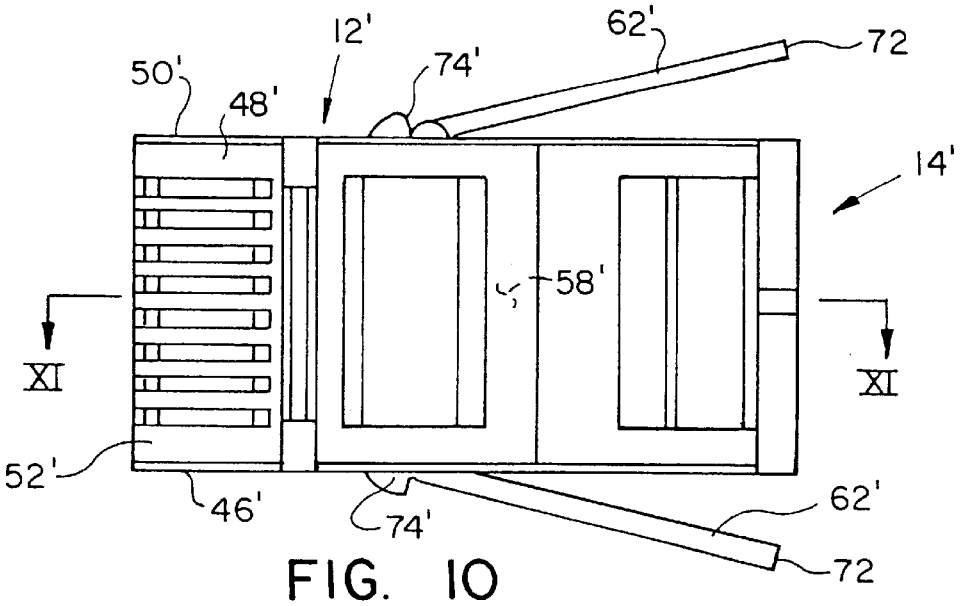
FIG. 10 is a top view of a second embodiment male plug according to the present invention.
Figure 13:
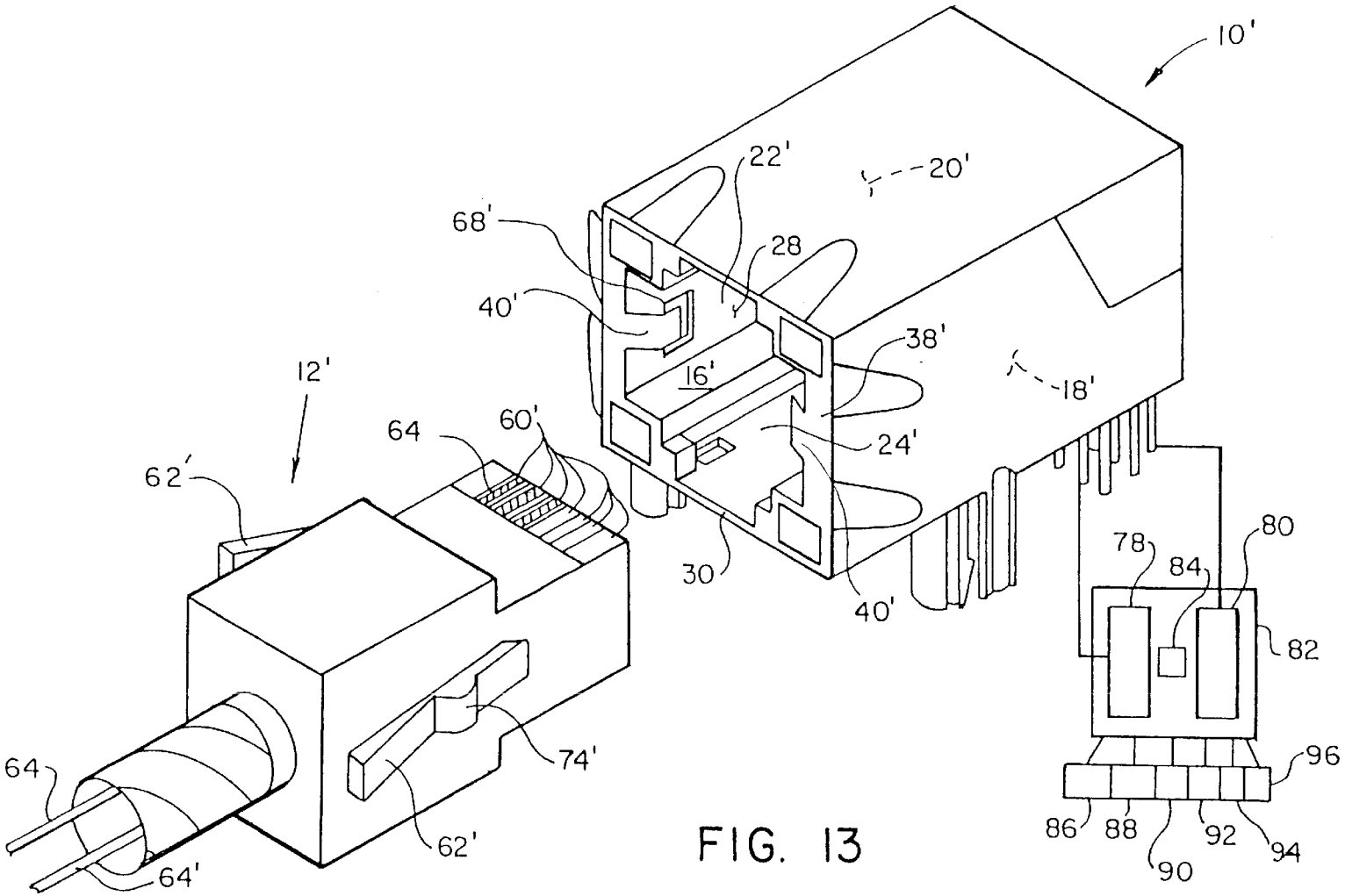
FIG. 13 is a perspective view of the female housing shown in FIG. 9 and the male plug shown in FIGS. 10–12.
Figure 15:
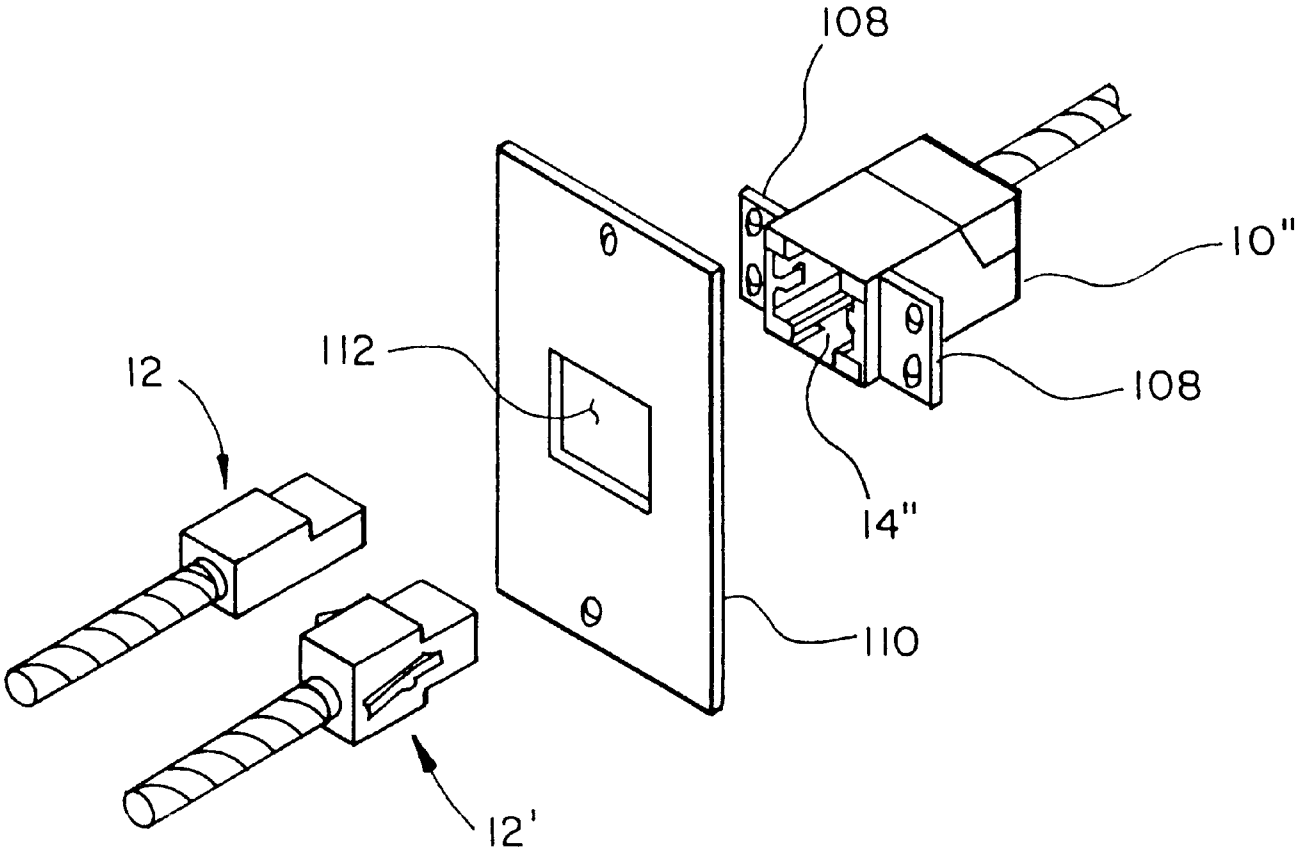
FIG. 15 is an exploded perspective view of a third embodiment female housing, a wall cover plate, and the first and second embodiment male plugs shown in FIGS. 6–8 and 10–14.
Figure 16:
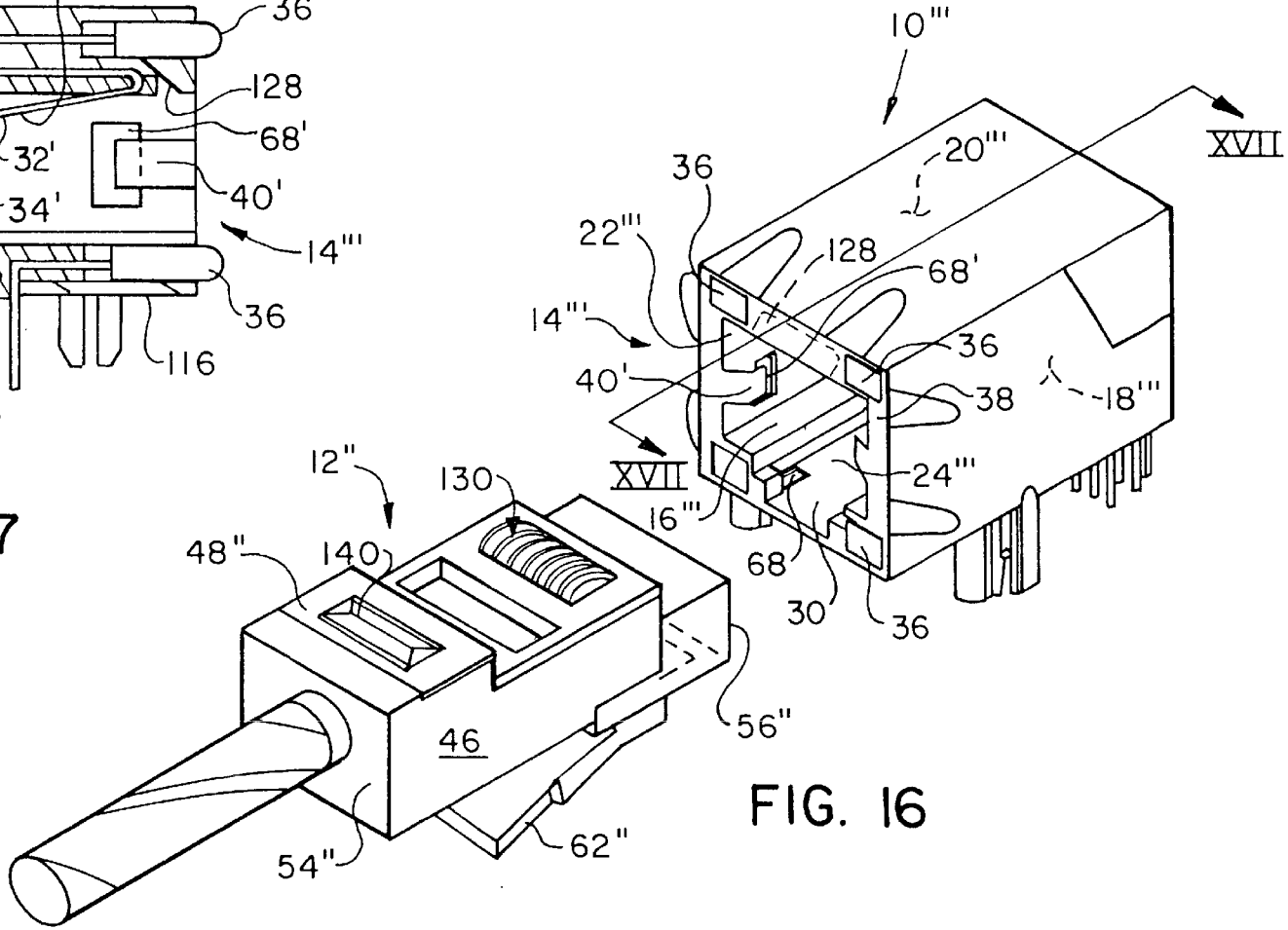
FIG. 16 is a perspective view of a fourth embodiment female housing and a third embodiment male plug.
Figure 17:
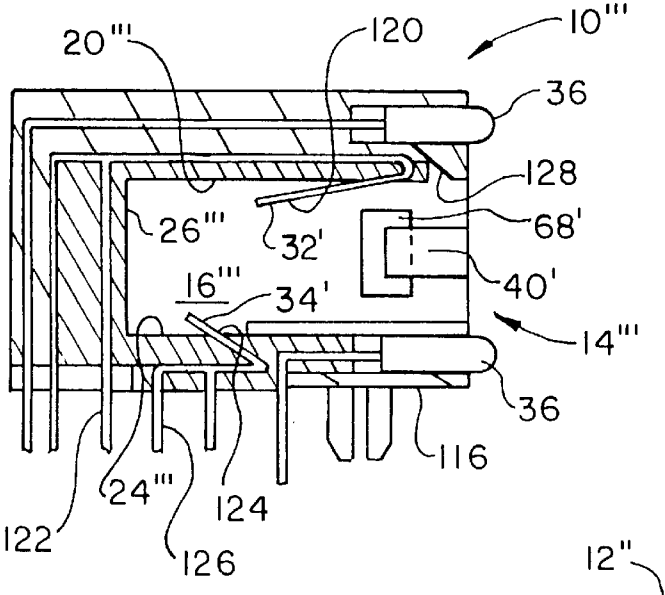
FIG. 17 is a cross-sectional side view of the fourth embodiment female housing shown in FIG. 16, taken along section line XVII—XVII.

A first embodiment female housing 10 according to the present invention is shown in FIGS. 1–8. A first embodiment male plug 12 according to the present invention is shown in FIGS. 6–8. A second embodiment female housing 10' is shown in FIGS. 9 and 13–14. A second embodiment male plug 12' is shown in FIGS. 10–14. A third embodiment female housing 10" is shown in FIG. 15. A fourth embodiment female housing 10'" is shown in FIGS. 16 and 17. A third embodiment male plug 12" is shown in FIGS. 16 and 18–20. For the purposes of this description, the female housing and the male plug are of the RJ-type. However, other types of multi-purpose modular connectors may also fall within the scope and spirit of the present invention.

Figure 1:
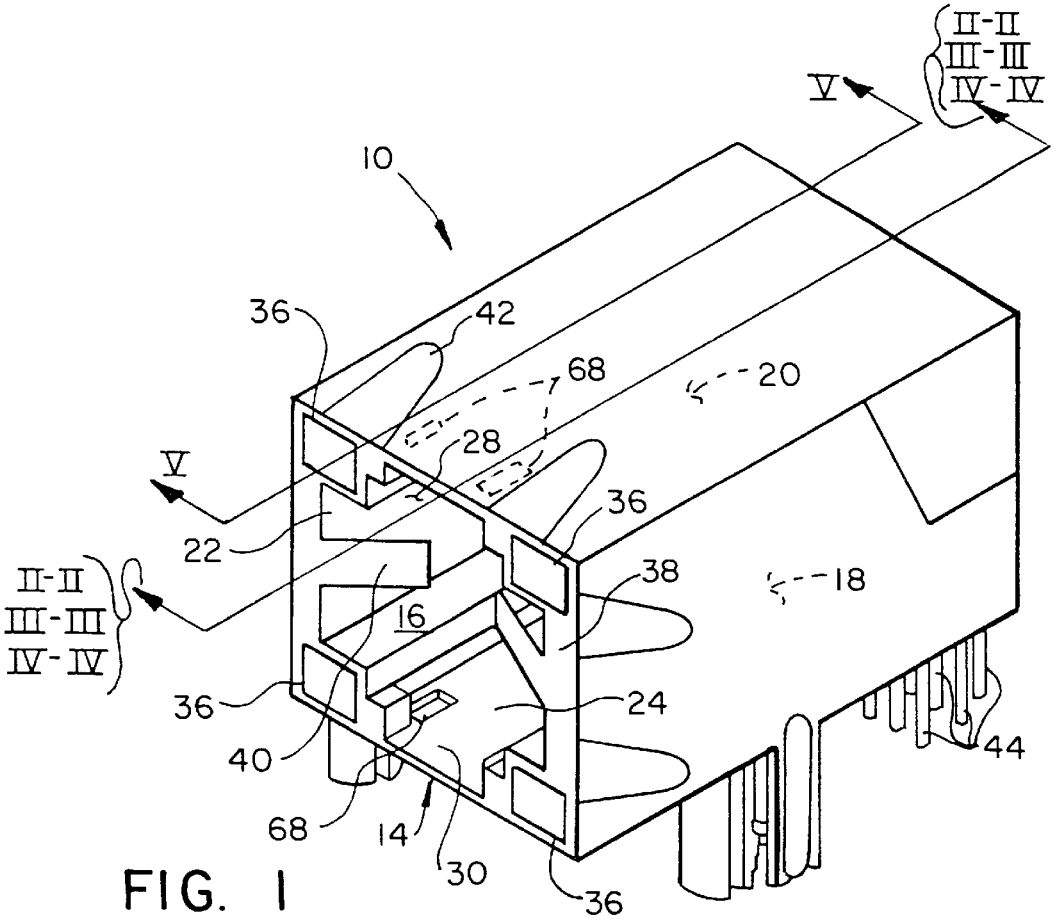
FIG. 1 is a perspective view of a first embodiment female housing according to the present invention.
Figure 2:
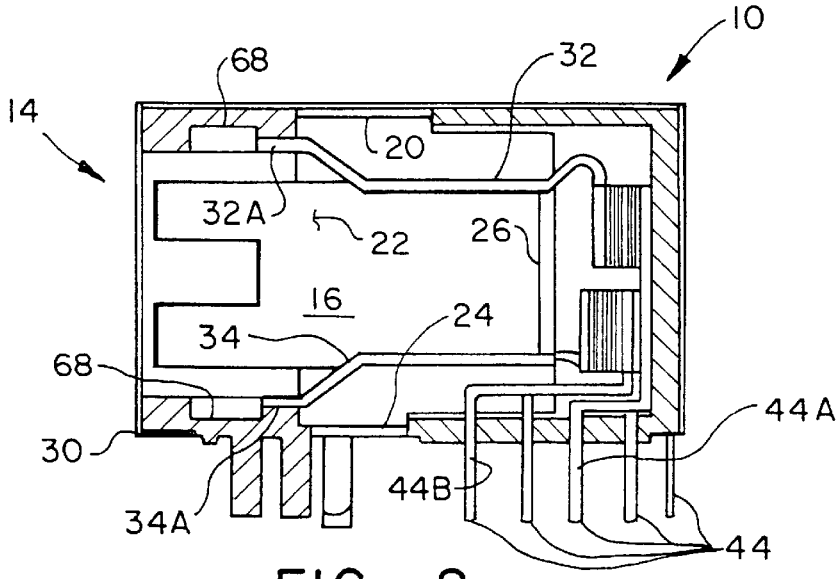
FIG. 2 is a cross-sectional side view of the female housing shown in FIG. 1, taken along section line II—II.

Referring to FIGS. 1 and 2, housing 10 is generally a hollow box-like structure defining an open end 14, an internal cavity 16, four interior surfaces 18, 20, 22, 24, and an interior end surface 26. Latch grooves 28, 30 are preferably defined by two or more of interior surfaces 18, 20, 22, 24, e.g., interior surfaces 20 and 24, respectively. It will be apparent to one skilled in the art, after reading this detailed description, that while four interior surfaces 18, 20, 22, 24 are preferred, only two or more interior surfaces are needed.

At least one first contact terminal 32 is received in female housing 10 adjacent one of interior surfaces 18, 20, 22, 24, e.g., interior surface 20, preferably adjacent one of the interior surfaces 20 and 24 defining one of the latch grooves 28, 30. At least one second contact terminal 34 is received in housing 10 adjacent another of interior surfaces 18, 20, 22, 24, e.g., interior surface 24, again preferably adjacent one of the interior surfaces 20 and 24 defining one of the latch grooves 28, 30. At least one second contact terminal 34 is received in housing 10 adjacent another of interior surfaces 18, 20, 22, 24, e.g., interior surface 24 again preferably, adjacent interior surfaces 18 and 22 defining latch grooves 28 and 30.

Figure 3:
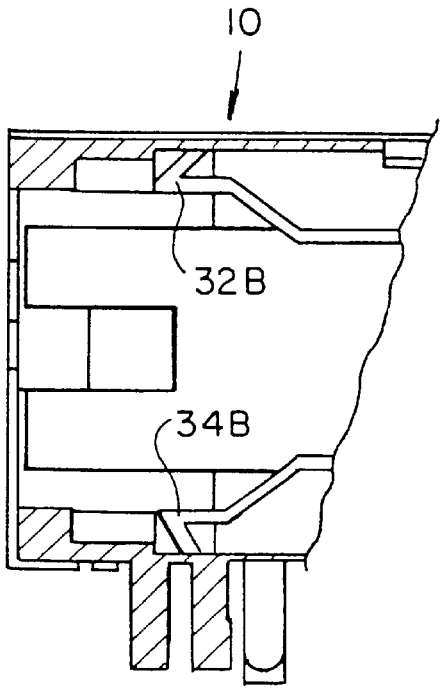
FIG. 3 is a partial cross-sectional side view of the female housing shown in FIG. 1, taken along section line III—III.

FIG. 2 shows flattened, spring-type contact terminals 32A, 34A for longer male plug travel and less spring back. FIG. 3 shows right angle, spring-type contact terminals 32B, 34B with medium travel and more moderate spring back. FIG. 4 shows C-bend, spring-type contact terminals 32C, 34C with little travel and greater spring back. It will be apparent to one skilled in the art that contact terminals currently are available in many sizes and shapes, and that the contact terminals 32, 34 discussed above are only examples of possible applications. Other suitable contact terminals 32, 34 may also be used.

Referring to FIGS. 5–8 and with continuing reference to FIG. 1, a male connector harness 38 includes at least one flexible tab 40 positioned adjacent open end 14 of female housing 10 along with a shield 42. One advantage of male connector harness 38 is that it compensates for differently-sized male plugs. For example, an RJ45 male plug typically having eight wires is generally wider than an RJ11 male plug typically having four wires. Hence, female housing 10 configured with four first contact terminals 32 and eight second contact terminals 34 should be sized to accept an RJ45-sized male plug. However, if internal cavity 16 of female housing 10 is sized to receive an RJ45 male plug, an RJ11 male plug having a width smaller than the RJ45 male plug would not properly fit internal cavity 16 of female housing 10. Male connector harness 38 helps to alleviate this problem via flexible tabs 40. When male plug 12 having a width substantially equal to the internal cavity 16 of female housing 10 is received in open end 14 of female housing 10, flexible tabs 40 are pressed in a direction toward interior surfaces 18 and 22 of female housing 10. However, when male plug 12 having a smaller width is inserted into internal cavity 16 of female housing 10, each flexible tab 40 applies a spring force to exterior surfaces of male plug 12 whereupon male plug 12 is held in place in internal cavity 16.

A plurality of leads 44 may extend away from female housing 10. FIG. 2 shows a lead 44A electrically connected to one of the first contact terminals 32 and another lead 44B electrically connected to one of the second contact terminals 34. FIG. 5 shows leads 44C, 44D each electrically connected to an LED 36 received in female housing 10. The ends of leads 44 extending outward from female housing 10 may be connected to one another or to some other object, such as a printed circuit board, such as by surface mounting, through hole mounting, ball grind array, or other suitable method. Plural female housings 10 can be stacked or bundled together in multiple ports.

Referring to FIGS. 6–8, internal cavity 16 of female housing 10 is configured to receive male plug 12. Male plug 12 is generally box-shaped and defines four external surfaces 46, 48, 50, 52, an open end 54, a closed end 56 and an internal cavity 58. One of external surfaces 46, 48, 50, 52, e.g., external surface 48, includes a plurality of partitioned wire grooves 60, with four, six, or eight partitioned wire grooves 60 being preferred. A collapsible wire holder (not shown) may be defined by one or more of external surfaces 46, 48, 50, 52, and at least one flexible latch 62 may be positioned adjacent to one or more of external surfaces 46, 48, 50, 52, with flexible latch 62 preferably defining at least one ridge 74 which releasably engages a latch divot 68 defined in one of the interior surfaces 18, 20, 22, 24, e.g., interior surface 24, of female housing 10 to secure male plug 12 inside internal cavity 16 of female housing 10. Flexible latch 62 is preferably positioned opposite the external surface 46, 48, 50, 52, e.g., external surface 48, defining the plurality of partitioned wire grooves 60. Male plug 12 may be an RJ11-type of male plug, an RJ45-type of male plug, or other type of male plug.

A single wire or a plurality of wires 64 is inserted into open end 54 of male plug 12 and strung through internal cavity 58 of male plug 12. An end 66 of each wire 64 is positioned in one of the plurality of partitioned wire grooves 60 whereupon each wire 64 is electrically insulated from other wires 64. The collapsible wire holder (not shown) is then compressed to hold each wire 64 securely within male plug 12.

One method of utilizing female housing 10 and male plug 12 is shown in FIGS. 6–8. Initially, male plug 12 is oriented in a first orientation with respect to female housing 10 whereupon flexible latch 62 lines up with latch groove 30.

Next, male plug 12 is inserted into open end 14 of female housing 10 whereupon flexible latch 62 releasably seats in latch groove 30 and the at least one ridge 74 releasably seats in one of the latch divots 68 of female housing 10. In this first orientation, end 66 of each wire 64 positioned in one of the partitioned wire grooves 60 of male plug 12 contacts one of the first contact terminals 32.

Male plug 12 may then be withdrawn from female housing 10 in a direction indicated by arrow A1. Once withdrawn, male plug 12, or a different male plug, may be oriented in a second orientation with respect to the female housing 10. This second orientation is achieved by rotating male plug 12 about its longitudinal axis L in a direction of arrow A2 or arrow A3. Male plug 12 may then be inserted into open end 14 of female housing 10. In this second orientation, the end 66 of each wire 64 positioned in one of the partitioned wire grooves 60 of male plug 12 contacts one of the second contact terminals 34. This dual functionality of the female housing 10 allows for the connectivity of one common function or two distinct functions.

Referring to FIGS. 9, 13 and 14, female housing 10' is similar to female housing 10 with like reference numerals indicating like parts. However, in female housing 10', each internal surface 18', 20', 22', 24' may or may not define a latch groove 28, 30, but each internal surface 18', 20', 22', 24' preferably defines additional latch divots 68'.

Figure 11:
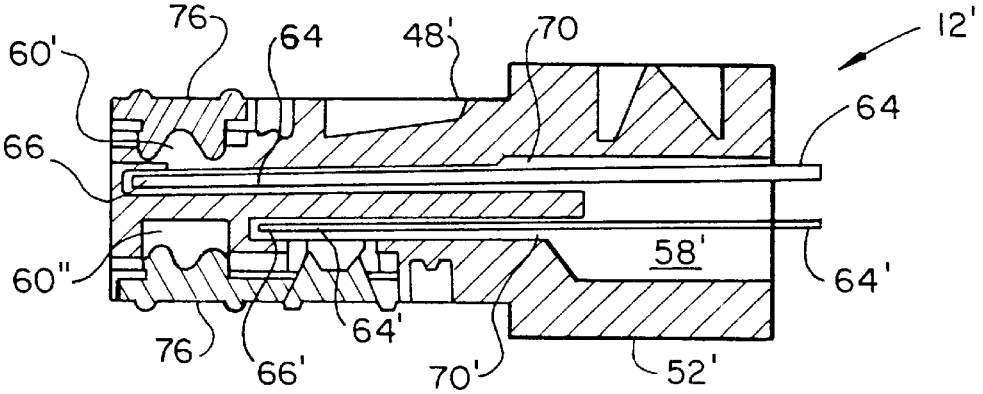
FIG. 11 is a cross-sectional side view of the male plug shown in FIG. 10, taken along section line XI—XI.
Figure 12:
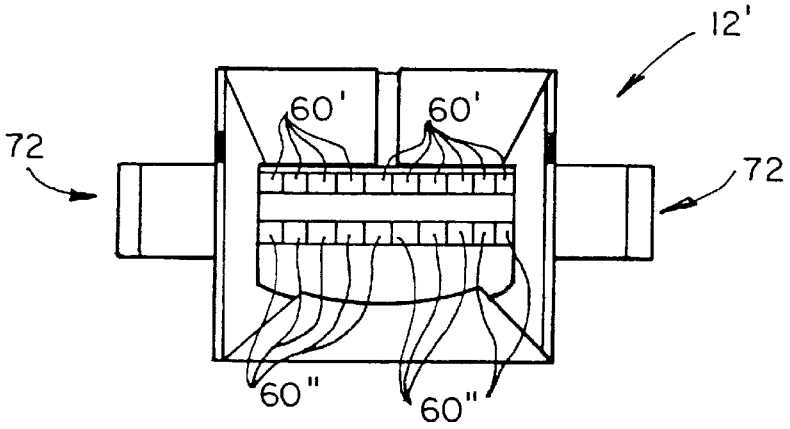
FIG. 12 is an end view of the male plug shown in FIG. 10.

Referring to FIGS. 9–14, male plug 12' is similar to male plug 12 with like reference numerals indicating like parts. Specifically, male plug 12' is generally box-shaped and defines an open end 14', external surfaces 46', 48', 50', 52' and an internal cavity 58'. As shown in FIG. 11, male plug 12' further defines one or more wire cavities 70 and one or more wire cavities 70'. Each wire cavity 70 and 70' is configured to receive a wire 64 and 64', respectively. Male plug 12' also includes one or more flexible latches 62'. Each flexible latch 62' includes an arm 72 and a ridge 74' for releasably engaging a corresponding flexible tab 40' and a corresponding latch divot 68' defined by female housing 10'.

One difference between male plug 12' and male plug 12 is that two or more of external surfaces 46', 48', 50', 52' define two sets of partitioned wire grooves 60', 60". A terminal tab 76 may be positioned in some or all of wire grooves 60' and 60". Male plug 12' may be an RJ11-type of male plug, an RJ45-type of male plug, or other type of male plug.

Male plug 12' receives two wires, two sets of plural wires 64 and 64', or any combination. It has been found that by having wire cavities 70, 70' with different lengths, two or more wires or plurality of wires 64, 64' can be housed in male plug 12' with adequate spacing and shielding therebetween to eliminate or reduce the amount of noise imposed on each wire 64 due to a signal transmitted on each wire 64', and vice versa. An end 66 of each wire 64 is positioned adjacent one of partitioned wire grooves 60'. An end 66 of each wire 64' is positioned adjacent one of partitioned wire grooves 60".

As shown in FIGS. 13–14, male plug 12' is inserted into internal cavity 16' of female housing 10' and can also be rotated into different orientations. Rotation of male plug 12' is not required if each wire 64 is connected to a first function 78 and each wire 64' is connected to a second function 80.

Another difference between male plug 12' and male plug 12 is that in male plug 12', each of flexible tabs 40' defined by male connector harness 38' and, preferably, each latch divot 68' defined by female housing 10' engages a ridge 74' of flexible latch 62' when male plug 12' is seated in female housing 10'. To release male plug 12' from female housing 10', arms 72 are moved toward male plug 12' until each ridge 74' unseats from its corresponding latch divot 68' and clears its corresponding flexible tab 40'. Male plug 12 may also be used in conjunction with the female housing 10'.

With reference to FIG. 15, female housing 10" is similar to female housing 10' with like reference numerals indicating like parts. However, female housing 10" defines wall brackets 108 configured to be mounted to a wall, electrical box, or other suitable device in a manner known in the art. Wall brackets 108 may then be covered by a cover plate 110 having an opening 112 corresponding to an open end 14" of female housing 10" for aesthetic purposes. As with female housing 10', female housing 10" may also be used in conjunction with either male plug 12 or male plug 12'.

With reference to FIGS. 16 and 17, female housing 10'" is similar to female housing 10 and 10' with like reference numerals indicating like parts. Female housing 10'" includes at least one first contact terminal 32' and at least one second contact terminal 34' received in female housing 10. Each first contact terminal 32' has leaf segment 120 which extends from adjacent open end 14'" into internal cavity 16'" and toward interior end surface 26'". Each first contact terminal 32' includes at an end thereof opposite leaf segment 120 a lead segment 122 which extends through a base 116 of female housing 10'" and away from base 116. Each second contact terminal 34' includes a leaf segment 124 which extends from intermediate open end 14'" and interior end surface 26'" into internal cavity 16'" and toward interior and surface 26'". Preferably, leaf segment 120 of each first contact terminal 32' is positioned on a side of internal cavity 16'" opposite leaf segment 124 of each second contact terminal 34'. More preferably, leaf segment 120 of each first contact terminal 32' is positioned adjacent interior surface 20'" and leaf segment 124 of each second contact terminal 34' is positioned adjacent interior surface 24'". Each second contact terminal 34' includes at an end thereof opposite leaf segment 124 a lead segment 126 which extends through and away from base 116.

To facilitate mating of female housing 10'" to a printed circuit board, lead segments 122 of alternating first contact terminals 32' are staggered and lead segments 126 of alternating second contact terminals 34' are staggered.

Lastly, female housing 10'" includes a latch surface 128 which slopes upwardly and away from open end 14'" adjacent interior surface 20'".

Figure 18:
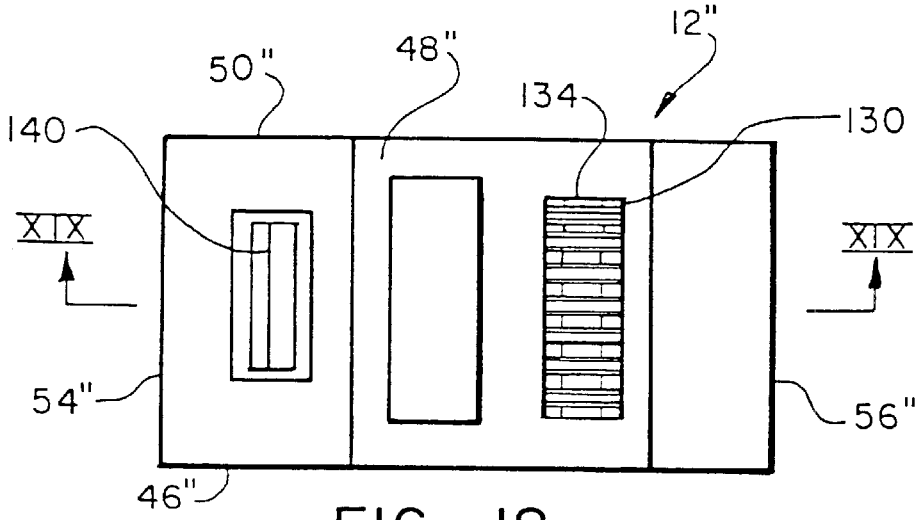
FIG. 18 is a top view of the third embodiment male plug shown in FIG. 16.
Figure 19:
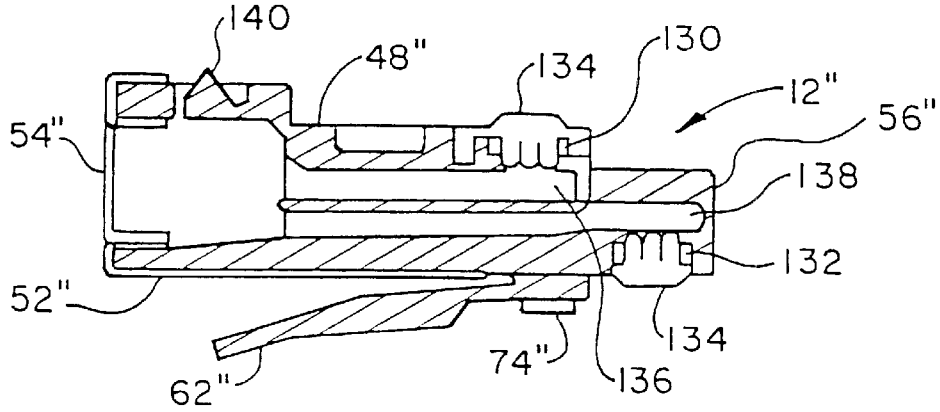
FIG. 19 is a cross-sectional side view of the third embodiment male plug shown in FIG. 16.
Figure 20:
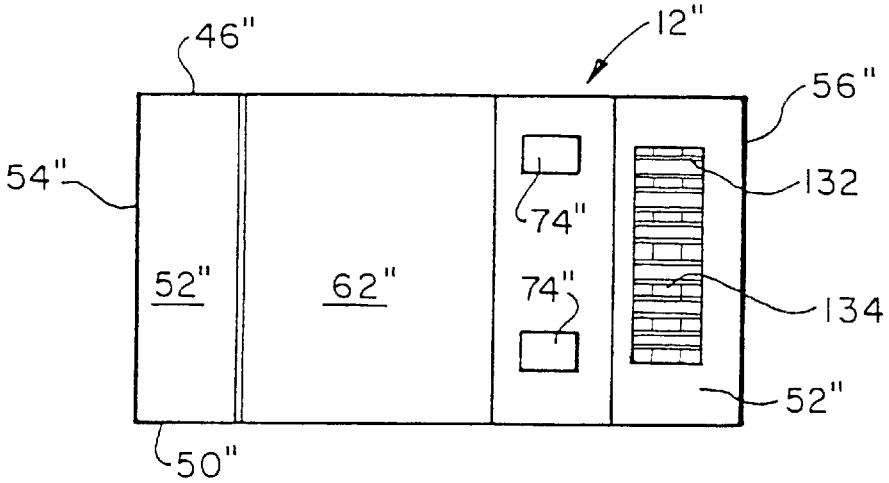
FIG. 20 is a bottom view of the third embodiment male plug shown in FIG. 16.

With reference to FIGS. 18–20 and with continuing reference to FIG. 16, male plug 12" includes a plurality of partitioned wire grooves 130 and a plurality of partitioned wire grooves 132 formed on opposite external surfaces thereof. More specifically, partitioned wire grooves 130 are formed in external surface 48" and partitioned wire grooves 132 are formed in external surface 52". For purpose of illustration, external surfaces 48" and 52" each include 8 partitioned wire grooves 130 and 132, respectively. However, external surface 48" can include four, six or eight partitioned wire grooves 130 and external surface 52" can include four, six or eight partitioned wire grooves 132.

Male plug 12" includes a plurality of wire cavities 136 and a plurality of wire cavities 138. Each wire cavity 136 is in communication with one of partitioned wire grooves 130 and each wire cavity 138 is in communication with one of partitioned wire grooves 132. Each partitioned wire groove 130 and 132 is configured to receive a conductive terminal tab 134. Each terminal tab 134 received in one of the partitioned wire grooves 130 is in communication with one of the wire cavities 136 formed in male plug 12" and each terminal tab 134 received in one of the partitioned wire grooves 132 as in communication with one of the wire cavities 138 formed in male plug 12". Each wire cavity 136 and each wire cavity 138 is configured to receive a wire (not shown) disposed therein via open end 54" of male plug 12". Each terminal tab 134 electrically contacts a wire received in the corresponding wire cavity 136 or 138.

Wire cavities 136 and 138 have different lengths so that when wires are properly seated therein the ends of the wires received in wire cavities 136 will be offset from the ends of the wires received in wire cavity 138. This offset provides adequate spacing and shielding to eliminate or reduce the amount of noise imposed on each wire received in wire cavity 136 due to a signal transmitted on each wire received in wire cavity 138, and vice versa.

Extending upwardly through external surface 48" adjacent open end 54" is a ridge 140. Ridge 140 is connected to a body of male housing 12" in a manner that enables ridge 140 to apply a spring force perpendicular and away from external surface 48" in response to the application of force on ridge 140 directed perpendicular to and toward external surface 48". In response to the removal of the force on ridge 140, the spring force returns ridge 140 to the position shown in FIG. 19.

Male plug 12" can be inserted into internal cavity 16'" of female housing 10'" with external surfaces 48" and 52" adjacent interior surfaces 20'" and 24'" , respectively. When male plug 12" is inserted into female housing 10'" , terminal tabs 134 received in partitioned wire grooves 130 electrically contact leaf segments 120 of first contact terminals 32', and terminal tabs 134 received in partition wire grooves 132 electrically contact leaf segments 124 of second contact terminals 34'.

As closed end 56" of male plug 12" moves toward interior end surface 26'" of female housing 10'" , ridge 140 is urged into male plug 12" by the lower end of latch surface 128. When ridge 140 clears the lower end of latch surface 128, the spring force causes ridge 140 to move upwardly and seat ridge 140 against latch surface 128. At the same time, ridges 74" of flexible latch 62" seat in latch divots 68 formed in interior surface 24'" of female housing 10'" adjacent open end 14"".

To remove male plug 12" from female housing 10'", the end of flexible latch 62" adjacent open end 54" is urged toward male plug 12" whereupon ridges 74" unseat from corresponding latch divots 68. Thereafter, male plug 12" is withdrawn from internal cavity 16'" of female housing 10'" against the spring force of ridge 140 against latch surface 128.

The embodiments of the present invention described above help to provide an RJ-type modular connector which is extremely flexible. Instead of providing two separate female housings and two separate male plugs (one set for telecommunications and one set for LAN connectivity) the present invention allows one female housing and one male plug to be used for both purposes. For example, FIG. 13 shows a female housing 10' electrically connected to a printed circuit board in an electronic device, such as a motherboard 82 of a computer. Motherboard 82 generally includes a logic processor 84, and the computer may further include a fixed magnetic hard drive 86, a removable magnetic hard drive 88, a floppy disk drive 90, a CD-ROM 92, a visual display 94, and/or a printer 96. Four first contact terminals 32 can be electrically connected to the electronic components on the motherboard which support the first function 78, such as the telecommunications function. Eight second contact terminals 34 can be electrically connected to electronic components supporting the second function 80, such as LAN function. However, any number and type of first and second contact terminals 32, 34 can be used depending on the particular application.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A multi-functional modular connector comprising:

an RJ-type female housing having an open, plug receiving end and two non-coplanar interior surfaces;

a first RJ-type contact terminal configuration positioned along one of the interior surfaces a first distance from the open, plug receiving end; and a second RJ-type contact terminal configuration positioned along the other interior surface a second, different distance from the open, plug receiving end.

2. The multi-functional modular connector as claimed in claim 1, further comprising an RJ-type male plug configured to be received in the open, plug receiving end of the RJ-type female housing, the RJ-type male plug selected from the group consisting of RJ11 and RJ45.

3. The multi-functional modular connector as claimed in claim 1, wherein the first contact terminal is connected to a first function and the second contact terminal is connected to a second function.

4. The multi-purpose modular connector as claimed in claim 1, wherein each contact terminal of the first contact terminal configuration and the second contact terminal configuration is selected from the group comprising a flattened spring-type contact terminal, a right angle spring-type contact terminal, and a C-bend spring-type contact terminal.

5. The multi-purpose modular connector as claimed in claim 1, further including at least one light emitting diode associated with the RJ-type female housing.

6. The multi-purpose modular connector as claimed in claim 5, wherein the light emitting diode is incorporated directly into the female housing.

7. The multi-purpose modular connector as claimed in claim 1, further comprising a plurality of leads which extend away from the female housing.

8. The multi-purpose modular connector as claimed in claim 7, wherein one of the plurality of leads is electrically connected to one of the contact terminals of the first contact terminal configuration and another of the plurality of leads is electrically connected to one of the contact terminals of the second contact terminal configuration.

9. The multi-purpose modular connector as claimed in claim 7, further comprising a first light emitting diode and a second light emitting diode, wherein one of the plurality of leads is electrically connected to the first light emitting diode and another of the plurality of leads is connected to the second light emitting diode.

10. The multi-purpose modular connector as claimed in claim 7, wherein the leads are further connected to a printed circuit board by a method selected from the group consisting of surface mounting, thru hole mounting and ball grid array.

11. The multi-purpose modular connector as claimed in claim 1, further comprising means for accommodating at least two RJ-type male plugs having different widths.

12. The multi-purpose modular connector as claimed in claim 11, wherein the means for accommodating includes a male connector harness having at least one flexible tab, wherein the male connector harness is positioned adjacent the open, plug receiving end of the RJ-type female housing.

13. The multi-purpose modular connector as claimed in claim 1, further comprising an RJ-type male plug configured to be inserted into the open, plug receiving end of the RJ-type female housing, the RJ-type male plug having two external non-coplanar surfaces that extend between a first end and a second end of the RJ-type male plug, a first plurality of wire grooves defined in one of the external surfaces a first distance from the first end and a second plurality of wire grooves defined in the other external surface a second, different distance from the first end.

14. The multi-purpose modular connector as claimed in claim 13, further comprising means for releasably locking the RJ-type male plug in the RJ-type female housing.

15. The multi-purpose modular connector as claimed in claim 14, wherein the means for releasably locking the RJ-type male plug in the RJ-type female housing includes a latch groove defined by at least one of the interior surfaces of the RJ-type female housing, a latch divot defined by at least one of the interior surfaces of the RJ-type female housing, and a ridge defined on a flexible latch of the RJ-type male plug, wherein the ridge releasably engages the latch divot when the RJ-type male plug is received in the open, plug receiving end of the RJ-type female housing.

16. A multi-functional RJ-type modular connector system comprising:

an RJ-type female housing having an open end and two non-coplanar interior surfaces;

a first plurality of RJ-type contact terminals positioned along one of the two interior surfaces a first distance from the open end;

a second plurality of RJ-type contact terminals positioned along another of the interior surfaces a second, different distance from the open end; and an RJ-type male plug conveying a first plurality of wires, the RJ-type male plug configured to be inserted in a first orientation into the open end of the RJ-type female housing whereupon at least one of the first plurality of wires electrically communicates with at least one of the first plurality of contact terminals.

17. The multi-functional RJ-type modular connector as claimed in claim 16, wherein the at least one of the first plurality of contact terminals is connected to a first function and the at least one of the second plurality of contact terminals is connected to a second function.

18. The multi-functional RJ-type modular connector system as claimed in claim 16, wherein:

the RJ-type male plug conveys a second plurality of wires; and when the RJ-type male plug is inserted in the first orientation into the open end of the RJ-type female housing, at least one of the second plurality of wires electrically communicates with at least one of the second plurality of contact terminals.

19. A multi-functional RJ-type modular connector comprising:

an RJ-type female housing having an open end and at least two non-coplanar interior surfaces;

a first RJ-type contact terminal configuration positioned along one of the two interior surfaces a first distance from the open end;

a second RJ-type contact terminal configuration positioned along another of the interior surfaces a second, different distance from the open end; and an RJ-type male plug having a first plurality of wires and a second plurality of wires, the RJ-type male plug configured to be inserted in the open end of the RJ-type female housing wherein, when the RJ-type male plug is inserted into the open end of the RJ-type female housing, at least one first contact terminal contacts a corresponding one of the first plurality of wires and the at least one second contact terminal contacts a corresponding one of the second plurality of wires.

20. The multi-functional RJ-type modular connector as claimed in claim 19, wherein the at least one first contact terminal is connected to a first function and the at least one second contact terminal is connected to a second function.

21. An electronic device comprising:

a printed circuit board;

an RJ-type female housing configured to receive an RJ-type male plug, the RJ-type female housing having an open, plug receiving end and least two non-coplanar interior surfaces;

a first RJ contact terminal configuration positioned along one of the interior surfaces a first distance from the open end of the RJ-type female housing; and a second RJ contact terminal configuration positioned along the other interior surface a second, different distance from the open end of the RJ-type female housing wherein, the first and second contact terminal configurations electrically contact first and second wire configurations of the RJ-type male plug when the plug is received in the open, plug receiving end of the RJ-type female housing.

22. The electronic device as claimed in claim 21, wherein the printed circuit board further comprises a logic processor.

23. The electronic device as claimed in claim 21, wherein the electronic device further comprises a component selected from the group consisting of a fixed magnetic hard drive, a removable magnetic hard drive, a floppy disk drive, a CD-ROM, a visual monitor, and a printer, wherein each component is electrically connected to the circuit board.

* * * * *

UNITED STATES PATENT AND TRADEMARK OFFICE

CERTIFICATE OF CORRECTION

PATENT NO. : 6,544,076 B2
DATED : April 8, 2003
INVENTOR(S) : Alan L. Pocrass

It is certified that error appears in the above-identified patent and that said Letters Patent is hereby corrected as shown below:

Title page,
Item [56], References Cited, U.S. DOCUMENTS, insert:

| | | | |
|---|---|---|---|
| -- 3,523,269 | B1 | 08/1970 | Witek, Jr. el. |
| 4,379,606 | B1 | 04/1983 | Clark et al. |
| 4,457,570 | B1 | 07/1984 | Bogese, II |
| 4,648,682 | B1 | 03/1987 | Tubbs |
| 4,978,317 | B1 | 12/1990 | Pocrass…….439/490 |
| 5,605,473 | B1 | 02/1997 | Kishon…….439/502 |
| 6,042,422 | B1 | 03/2000 | Youtsey……439/585 |
| 6,290,538 | B1 | 09/2001 | Pocrass…….439/578 --. |

Column 7,
Line 44, "14"" " should read -- 14'" --.

Signed and Sealed this

Second Day of September, 2003

JAMES E. ROGAN
*Director of the United States Patent and Trademark Office*